United States Patent [19]

Perry et al.

[11] Patent Number: 4,878,675

[45] Date of Patent: Nov. 7, 1989

[54] EDUCATIONAL AND AMUSEMENT GAME

[76] Inventors: Timothy Perry; Leroy Perry, both of P. O. Box 788, Ellicott City, Md. 21043

[21] Appl. No.: 230,593

[22] Filed: Aug. 10, 1988

[51] Int. Cl.[4] ..... A63F 3/00; A63F 3/06

[52] U.S. Cl. ..... 273/251; 273/243; 273/269

[58] Field of Search ..... 273/269, 243, 248, 274, 273/251

[56] References Cited

U.S. PATENT DOCUMENTS

| | | | |
|---|---|---|---|
| 1,723,377 | 8/1929 | Salomon | 273/269 |
| 3,427,027 | 2/1969 | Kenyon | 273/243 |

FOREIGN PATENT DOCUMENTS

| | | | |
|---|---|---|---|
| 451954 | 10/1948 | Canada | 273/269 |
| 1172231 | 11/1969 | United Kingdom | 273/269 |

*Primary Examiner*—Edward M. Coven
*Assistant Examiner*—Benjamin Layno
*Attorney, Agent, or Firm*—Leon Gilden

[57] ABSTRACT

A method for playing an educational and amustment game. The board game provides for playing two separate games. In the first game, game cards similar to bingo cards are distributed to each player. Game emblems or pieces start at a corresponding "Home" space and move along the inner path according to the roll of dice. Each inner space has a representation of a conventional playing card. After moving a game piece, the player must guess whether the playing card about to be picked from a conventional deck of playing cards is higher, lower or the same as the playing card represented on the landed space. Upon a correct guess, the player places a token on the space on his game card which corresponds to the landed space. If the guess is incorrect, question cards or reward and penalty cards may be used to give the player another opportunity to fill his game card. In the second game, players' pieces move along the outer path according to the roll of dice. Instructions on the outer spaces must be followed. The instructions and questions on the game board spaces and on the cards pertain to hazards and pitfalls associated in the use of addictive substances such as alcohol, tobacco and drugs.

5 Claims, 11 Drawing Sheets

EDUCATIONAL AND AMUSEMENT GAME

BACKGROUND OF THE INVENTION

1. Field of the Invention

The instant invention relates to games of amusement and more particularly pertains to a new and improved educational and amusement game wherein players may be apprised of the hazards of addictive substances as well as an availability of an alternative game to simulate vehicluar travel through the United States.

2. Description of the Prior Art

The use of educational and amusement games is well known in the prior art. The purpose of such games is generally to amuse and provide carefree passage of time during the course of play. There exists a need, however, in contemporary times to educate individuals in the dangers and hazards of addictive drug, alcohol and tobacco utilization.

An example of a prior art game for use in conveying educational message may be found in U.S. Pat. No. 4,109,918 to Mele. The Mele game utilizes a game of chance wherein participants are moved about a path of travel with associated cards to impart learning in the field of financial understanding during the course of travel about the game board.

U.S. Pat. No. 4,123,062 to Wexler utilizes a multiple token, multiple position game wherein an individual of a plurality of players may choose from a variety of strategies and approaches in playing the game to attempt to achieve an ultimate goal of becoming victorious over fellow players. The multiple choice strategy game utilizes elements of chance and judgment arising from random orientation upon the manipulation of the discrete identification means employing the use of dice.

U.S. Pat. No. 4,129,304 to Mager sets forth a series of game embodiments that essentially includes chips to be wagered and randomly choosing a location on a game board for the chips, and a plurality of pieces representing individal players for movement about the locations on the game board to capture such chips.

U.S. Pat. No. 4,359,226 to Neff sets forth a game board employing celestial concepts of Karma based on Far Eastern cultural with impediments and advantageous in traverse of individuals about the game board.

U.S. Pat. No. 4,484,747 to Breslow, et al., sets forth a game board including a dispenser for dispensing playing pieces one at a time onto the playing surface in coordination with movement of players about the game board.

As such, it may be appreciated that there is continuing need for a new and improved educational and entertainment game that addresses both the problems of education of contemporary use associated with substance addiction and further enables utilization of the game board for amusement purposes in a secondary game and in this respect, the present invention enables selective play by a plurality of individuals for varying purposes of education and amusement.

SUMMARY OF THE INVENTION

In view of the foregoing disadvantages inherent in the known types of educational and amusement games now present in the prior art, the present invention provides an educational and amusement game wherein the same enables dual utilization of a single game board to control the degree of educational or amusement impact upon the players. As such, the general purpose of the present invention, which will be described subsequently in greater detail, is to provide a new and improved educational amusement game which has all the advantages of the prior art educational and amusement games and none of the disadvantages.

To attain this, the present invention comprises a game board utilizing a central area from which individuals may initiate play about one of a plurality of perimeter paths of play wherein a first path employs a plural series of play that enables traverse about the game board by use of a dice, and may include features to impart educational impact in the use of addictive substances by employing various penalty and reward cards as well as question and answer cards during traverse of the path. A second path of travel enables travel about an outer perimeter path on the game board to provide amusement and educational understanding of the States of the United States of America and potential problems associated with travel through the States.

My invention resides not in any one of these features per se, but rather in the particular combination of all of them herein disclosed and claimed and it is distinguished from the prior art in this particular combination of all of its structures for the functions specified.

There has thus been outlines, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abastract is to enable the U.S. Patent and Trademark Office and the public generally, and especially the scientists engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved educational and amusement game which has all the advantages of the prior art educational and amusement games and none of the advantages.

It is another object of the present invention to provide a new and improved educational and amusement game which may be easily and efficiently manufactured and marketed.

It is a further object of the present invention to provide a new and improve educational and amusement game which is of a durable and reliable construction.

An even further object of the present invention is to provide a new and improved educational and amusement game which is susceptible of a low cost of manufacture with regard to both materials and labor, and which accordingly is then susceptible of low prices of sale to the consuming public, thereby making such educational and amusement games economically available to the buying public.

Still yet another object of the present invention is to provide a new and improved educational and amusement game which provides in the apparatuses and methods of the prior art some of the advantages thereof, while simultaneously overcoming some of the disadvantages normally associated therewith.

Still another object of the present invention is to provide a new and improved educational and amusement game wherein a game board provides plural paths of travel and wherein an inner path of travel enables various levels of play to impart various levels of education onto users of the game board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, referece should be had to the accompanying drawings and descriptive matter in which there is illustrated preferred embodiments of the invention.

BRIEF DESCRIPTION OF THE DRAWINGS

The invention will be better understood and objects other than those set forth above wil become apparent when consideration is given to the following detailed description thereof. Such description makes reference to the annexed drawings wherein:

FIG. 6 is a top orthographic view of a second portion of the game board.

FIG. 7 is a top orthographic view of a third portion of the game board.

FIG. 8 is a top orthographic view of a fourth portion of the game board.

FIG. 10 is a top orthographic view of a sixth portion of the game board.

FIG. 17 is a bottom orthographic view of a typical question and answer card as utilized by the instant invention.

FIG. 18 is a top orthographic view of a typical question and answer card as utilized by the instant invention.

FIG. 19 is an isometric illustration of the question and answer card holder as utilized by the instant invention.

DESCRIPTION OF THE PREFERRED EMBODIMENT

Figure 1:
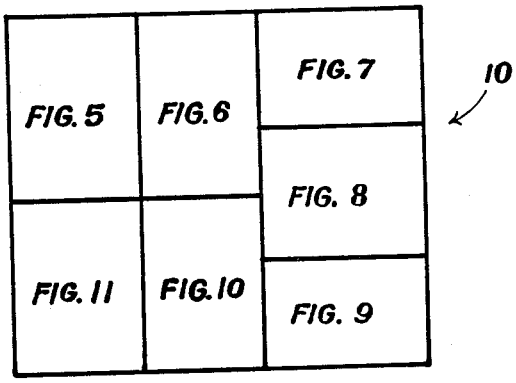
FIG. 1 is a top orthographic view of a representative diagram of the game board of the instant invention designating the corresponding figures associated together.

With reference now to the drawings, and in particular to FIGS. 1 to 19 thereof, a new and improved educational and amusement game embodying the principles and concepts of the present invention and generally designated by the reference numeral 10 will be described.

More specifically, the educational and amusement game apparatus includes a game board as represented by the numeral 10 in FIG. 1. The details of the game board are more specifically presented in FIGS. 5 through 11 in orientation relative to each other, as illustrated in FIG. 1.

Equipment utilized in the playing of the Control game includes utilization of an emblem to indicate position of a player about a game board. The emblem may be of any configuration and typically a coin, such as a penny, nickel, dime, and quarter, may be utilized for use by each of the players up to the four positions available on the game board indicated by the Home positions 14 and the Control positions 15. The Control game spaced 16 are arranged as representative depictions of playing cards as indicated in FIGS. 5 through 11, at spaces 16 oriented about an inner perimeter of the game board 10.

Figure 2:
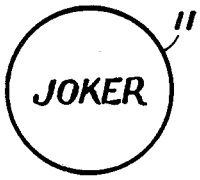
FIG. 2 is a top orthographic representative view of a Joker token utilized by the instant invention.
Figure 3:
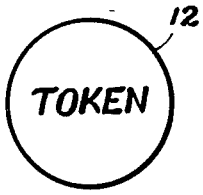
FIG. 3 is a top orthographic representative view of a token utilized in traverse of the game board of the instant invention.
Figure 12:
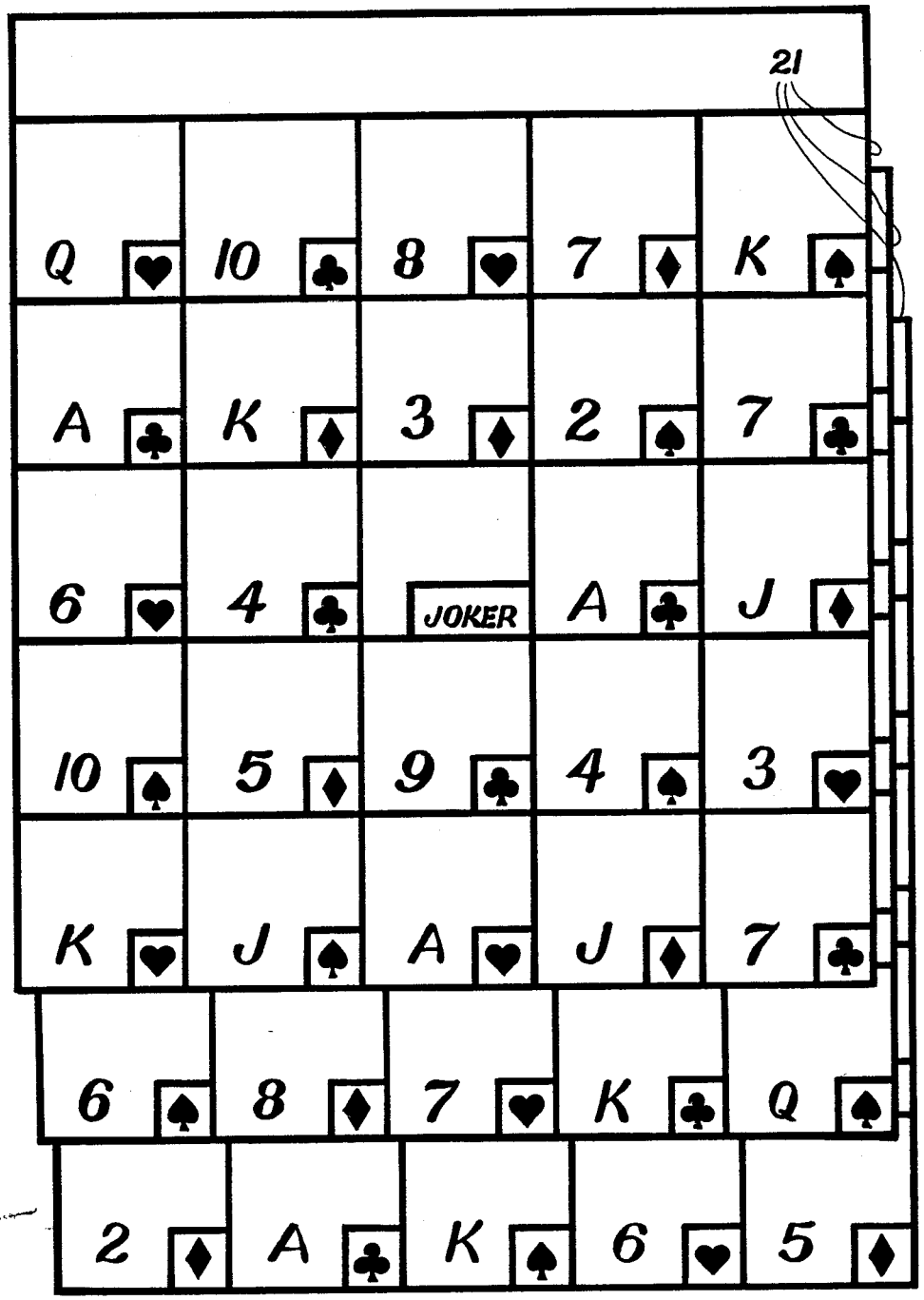
FIG. 12 is a top orthographic of a series of game cards as utilized by the instant invention.

FIG. 2 illustrates a Joker token 11 utilized optionally in the playing of the Control game where FIG. 3 is representative of a typical token 12 utilized in playing of the Control game for indication on the game cards 21, as illustrated in FIG. 12. The game cards 21 of FIG. 12 are provided with a random, non-repeated series of spaces to correspond to a playing card, such as a queen of hearts, a ten of clubs, etc.

Figure 13:
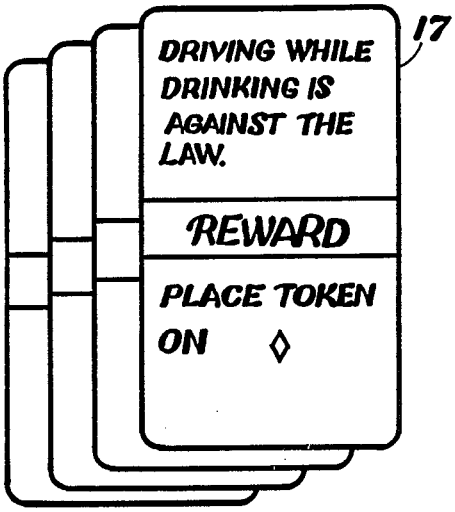
FIG. 13 is a top orthographic view of representative reward cards as utilized by the instant invention.
Figure 15:
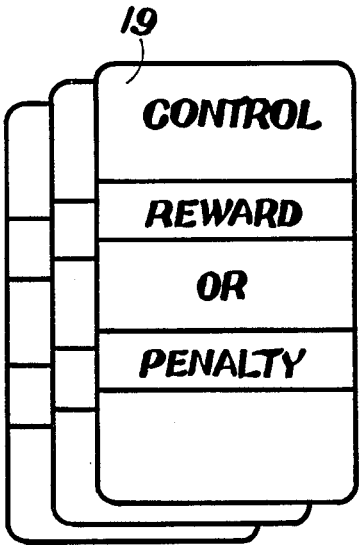
FIG. 15 is a top orthographic view of representative reward or penalty cards utilized by the instant invention illustrating their reverse sides as opposed to those sides illustrated in FIGS. 13 and 14.
Figure 14:
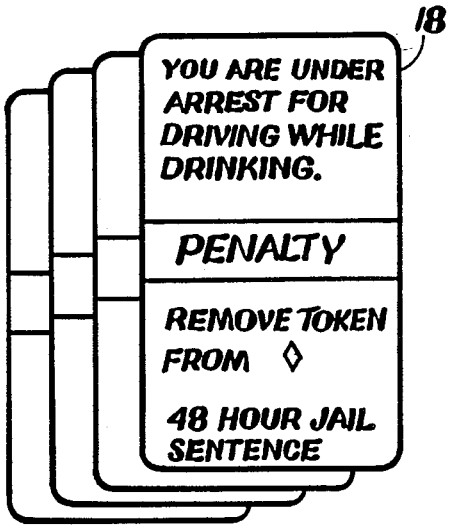
FIG. 14 is a top orthographic view of representative penalty cards as utilized by the instant invention.
Figure 16:
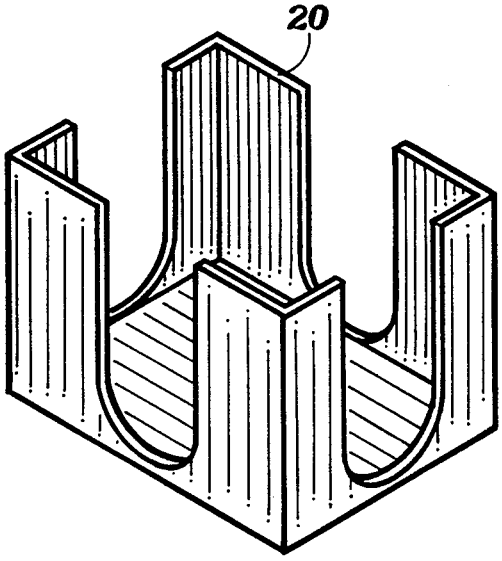
FIG. 16 is an isometric illustration of a playing card holder for securement of a plurality of decks of conventional playing cards.
Figures 11A, 11B, 11C, 11D:
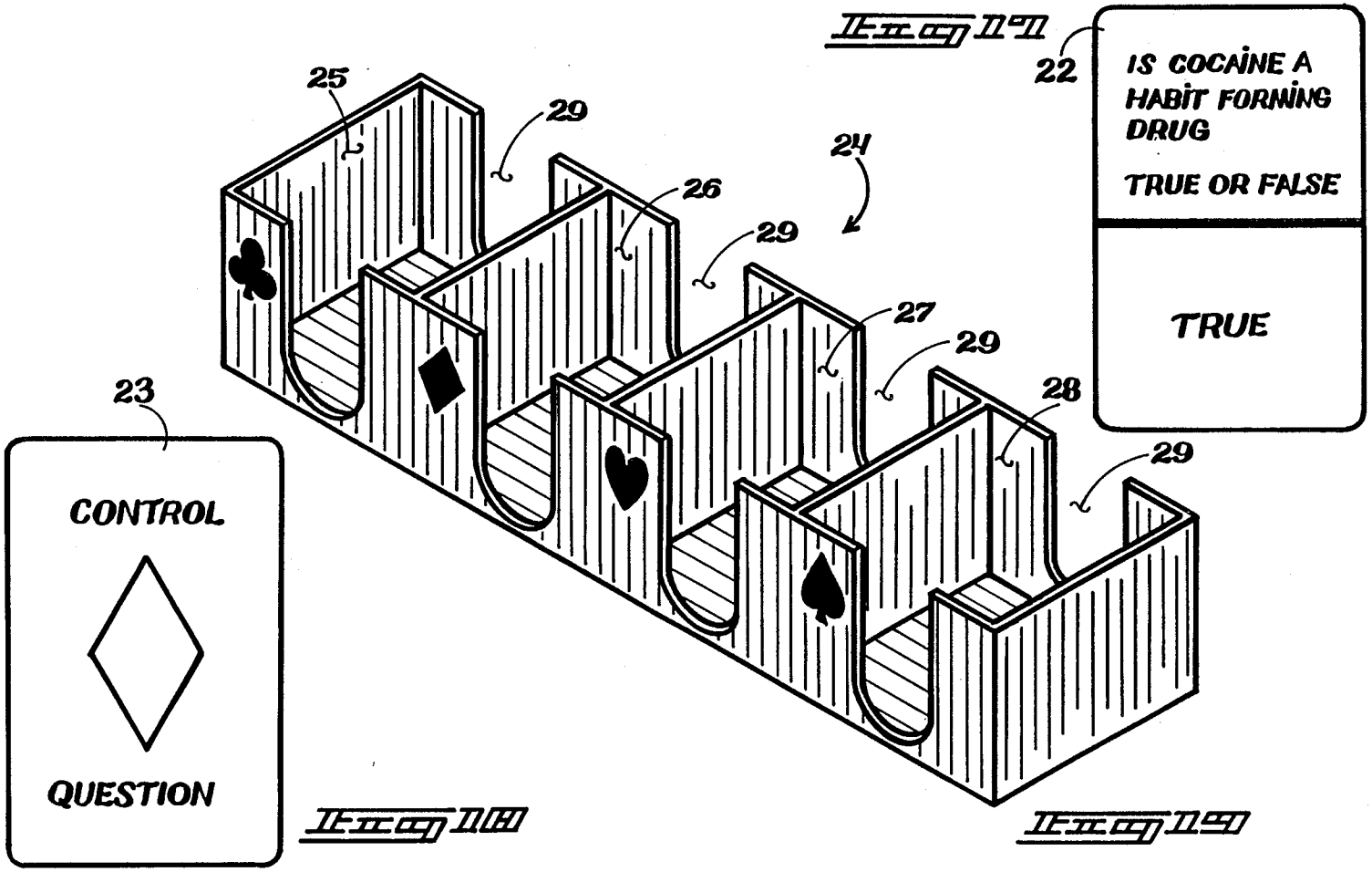

FIG. 13 illustrates a typical reward card position wherein an educational statement is set forth across the uppermost portion of the reward card face 17 with the consequence of choosing that reward card set forth on the bottom portion of the reward card, as illustrated in FIG. 13. FIG. 14 illustrates a typical. penalty card utilized by the instant invention wherein a factual situation is presented with an appropriate consequence to be derived therefrom set forth in the bottom portion of the penalty card 18. FIG. 15 sets forth the top faces of the reward and penalty cards which are identical as they are shuffled and stacked within the reward card holder 20 formed with a series of upstanding legs at each corner for containment of the cards face down therein with appropriate vertical access slots to gain immediate access to the individual cards 17 and 18.

FIG. 17 illustrates a typical question and answer card 22 for use in playing of the Control game with a typical question to be asked and the correct answer therebelow. FIG. 18 illustrates the top face 23 of the question and answer cards to be positioned within the question and answer card holder 24. The holder 24 is formed with four compartments comprising a first compartment 25, a second compartment 26, a third compartment 27, and a fourth compartment 28 formed with access slots 29 on forward and rear faces thereof. The various compartments are formed for the separation of the question and answer cards into the four various playing card categories that include clubs, diamonds, hearts, and spades associated with the respective four compartments 25 through 29.

The Control game includes the playing board 10, as illustrated in detail in FIGS. 5 through 11, one dice, sixty reward and penalty cards wherein forty-five reward cards 17 are utilized and fifteen penalty cards 18 are utilized in a typical and exclusive array. One hundred question and answer cards 22 are utilized wherein twenty-five of each category of clubs, diamonds, hearts, and spades are poisitioned within the respective compartments of the card holder 24. A card holder 16 is utilized that may typically store two decks of conventional playing cards (not illustrated) of fifty-four playing card each including the fifty-two playing cards, as are typically found in a conventional deck plus two Jokers. the four enblems, such as the coins that have been discussed above, are utilized for representation of each of the players with associated four jail cages 14 (illustrated in FIG. 4) for placement of an emblem as required by a penalty card 18, to be discussed in more detail below. There are one hundred tokens 12 to be utilized that are separated into twenty-five for each player as there are twentyfive spaces on each game card 21 that may be filled. Further, eight Joker tokens 11 are utilized in a manner to be discussed in the playing of the game below.

The object of the game is for players to move their emblems from the respective Home spaces 14 in a clockwise manner about the game board 10, and more particularly the respective Control game spaces 16 until one player fills a game card 21 with five tokens lines up either vertically, horizontally, or diagonally wherein the central Joker space, as illustrated in FIG. 12, counts as a token-free space or position to be employed by a player. Typically, players will move about the inner perimeter spaces 16 more than once in order to fill a game cards 21. The game continues until at least one game card is filled, as noted. The game board accommodates four players with the four associated Home spaces 14 and the Control spaces 15 associated with each Home space.

OPTIONS OF PLAYING THE GAME

There are three optional ways to play the game:

1. The basic game play utilizes only the two aforenoted decks of playing cards.
2. The use of the reward and penalty cards wherein the two decks of playing cards are used in combination to the set of reward and penalty cards, as noted above.
3. Question and answer cards are utilized wherein the two decks of playing cards are used in combination with the question and answer cards 22.

START OF THE GAME

Each player utilizing an emblem, such as a distinctive coin, places their emblem on each Home space 14 of the game. Players will then sequentially roll a dice wherein a player with the highest number begins. In case of a tie, the dice is rolled again until the highest number is awarded a winner. A player must initially proceed from the Home space 14 to a Control space 15. In order to do this, a one or a six must be rolled by a dice utilized in the play of a game and of conventional configuration of six sides.

If a one or a six is rolled, the player rolling such number will move to a Control space 15 and await the next round before proceeding. The dice is then passed to the next player that rolled the second highest score in the beginning of the game. The aforenoted two decks of conventional playing cards of 54 cards each are then positioned face down on a surface of the game board 10 for access by each of the players.

Figure 5:
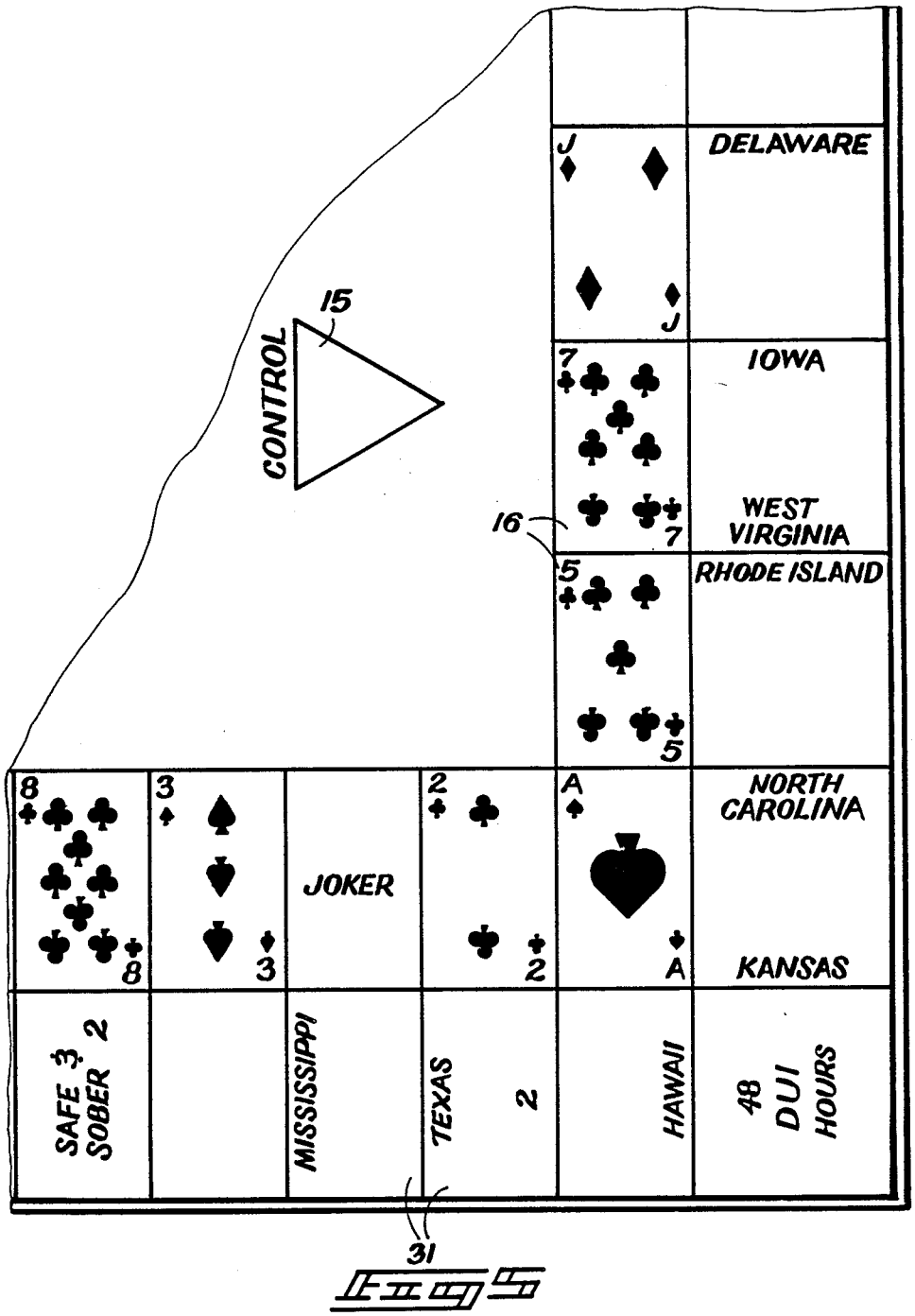
FIG. 5 is a top orthographic view of a first portion of the game board.

A player, upon a furher turn, will roll a dice and then will move along a playing surface opposed to the apex of the Control space 15 wherein FIG. 5, for example, will allow a player to start and move into the seven of club space to start. For example should that player roll a two, he will move in a clockwise manner from the seven of clubs to the five of clubs in corresponding to the number rolled by the dice. Upon a player movement into a designated space, such as a five of clubs, a playing card will then be taken from the top of the two decks whereupon a player must, prior to pulling the playing card, announce where that card to be pulled, will be higher, lower, or the same as the space on which he has landed wherein this exemplary case would be the five of clubs.

If the player has guessed correctly that the card is higher, lower, or the same, then that player has an opportunity to place a token 12 onto a like designated space of card 21. The space on the game card 21 must correspond to the space as landed upon by the player wherein this example would be the five of clubs. Here the five of clubs is not set forth in the top playing card 21, as illustrated in FIG. 12, and therefore a player must await a further turn to attempt to position a token 12 onto a game card space of the game card 21.

Figure 4:
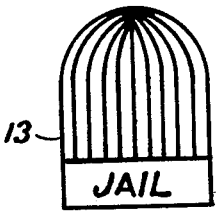
FIG. 4 is an orthographic view taken in elevation of a jail cage utilized in the play of the instant invention.

If the "guess" as set forth above was incorrect, then that player forfeits the turn and the player immediately to the left may then proceed with a turn. In the second option of playing the game reward and penalty cards are utilized to give the player with the incorrect guess another opportunity. After the incorrect guess to be the player must pull a reward and penalty card 19, as illustrated in FIG. 15, from within the associated holder 20. If a reward card is selected, then a player may place a token 12 upon a game card space FIG. 12 as designated by the suit shown on the reward card. In this case a diamond, indicated in FIG. 13. Here the diamond may refer to any of the diamonds such as a king of diamond, seven of diamond, as indicated on the top game card 21 of FIG. 12. Should a penalty card 18 be chosen, as illustrated in FIG. 14, then the players emblem must be removed from the game board 10 and positioned within the jail cage 13, as illustrated in FIG. 4. With the penalty card example, as illustrated in FIG. 14, a forty-eight hour jail sentence equates to a loss of two turns wherein each "twenty-four hour sentence" equates to the loss of one turn.

If a Joker is pulled from the one hundred and eight playing cards, the player automatically gets an opportunity to place a token on the game card - the guess as to the higher, lower, or exact matching of the playing card is ignored but there must be an exact match as before between the space landed upon by the emblem and the space available on the playing card 21 wherein an example chosen, since a five of clubs is not illustrated in the top playing card 21, the player could not place a token thereon. If a player lands on a Joker space, such as illustrated in FIG. 5 on the game board 10, that player need not select a playing card from the deck, but may at that point place a token 12 anywhere on his game board 21. In the third option of playing the game question and answer cards are utilized to give the player with the incorrect guess another opportunity.

The particular compartment from which a question and answer card is pulled, be it compartment 25, 26, 27, or 28, will be determined upon the suit of the space 16 a player lands where an example chosen, since a player has landed on the five of clubs, a question and answer card must be pulled from the first compartment 25 of the suit of clubs. If the player correctly answers the question, the player places a token on a game card space as designated by the suit on the question card. In this case, any clubs space.

The use of the Joker tokens 11 may expedite the playing of the game wherein each player may be provided one or two Joker tokens each which may be placed on a game card 21 at any time by the player. The Joker tokens may not be repositioned about the game card once they are utilized and may therefore by strategicaly employed by a player to finish a row and expedite winning of the game.

DRIVING THE U.S.A. INTERSTATE (D.U.I.)

A secondary game may be played utilizing the game board 10 wherein a number of positions of the D.U.I. spaced 30 are utilized adjacent each Home space. Each D.U.I. space 30 is utilized by one of up to four players and also utilizes an emblem, such as a penny, nickel, dime, or quarter,as utilized by each of the players. The game of D.U.I. is utilized with the D.U.I. playing spaces 31 and the players are to move clockwise about the spaces 31 wherein the object of the game is to start with a player as in the Control game starting from the Home position 14 and upon rolling a one or a six, may proceed to a D.U.I. space 30. A player to proceed about the board clockwise and return to the D.U.I. space 30 upon completion of the outer perimeter route employing the spaces 31 will be declared the winner. Upon each player selecting a corresponding emblem, a player who rolls the highest dice score will start the game. The first player with the first turn rolls the dice wherein a one or six as before must be utilized to move from a Home space 14 to a D.U.I. space 30. The next player is then given a similar opportunity to move from a Home space to a D.U.I. space.

Figure 11:
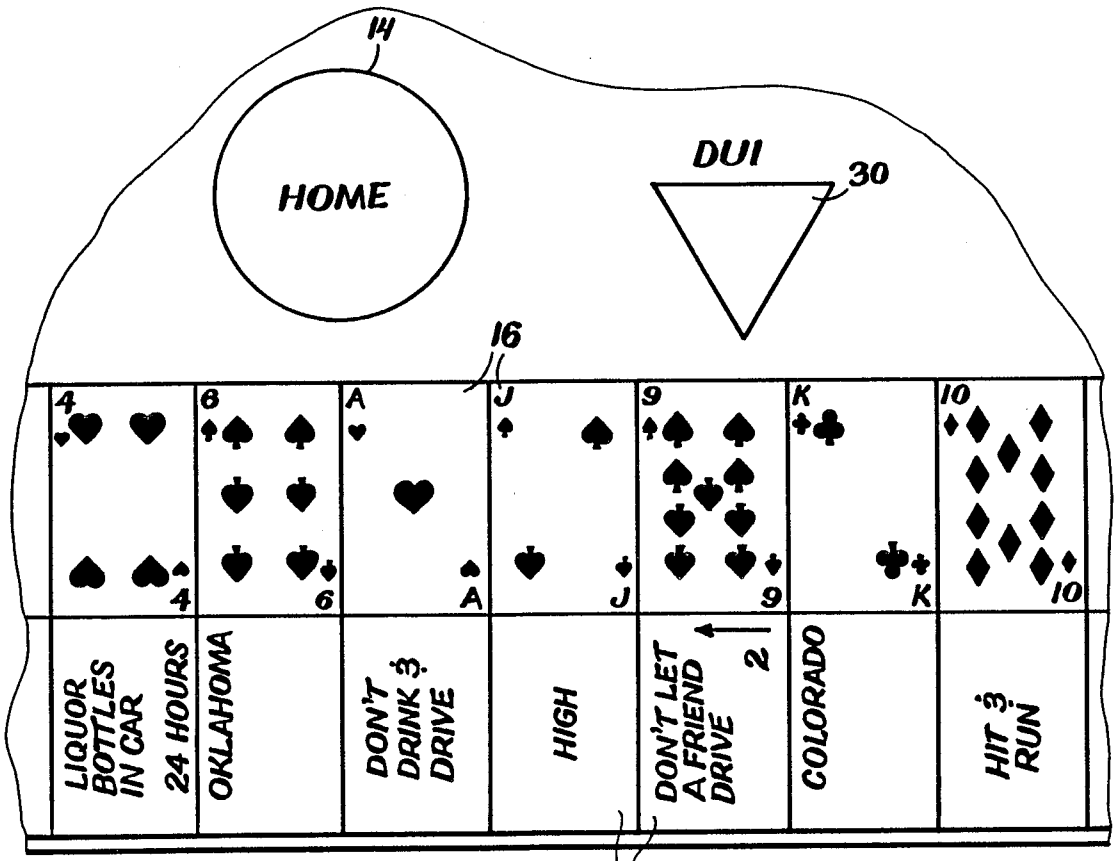
FIG. 11 is a top orthographic view of a seventh portion of the game board.
Figure 11:
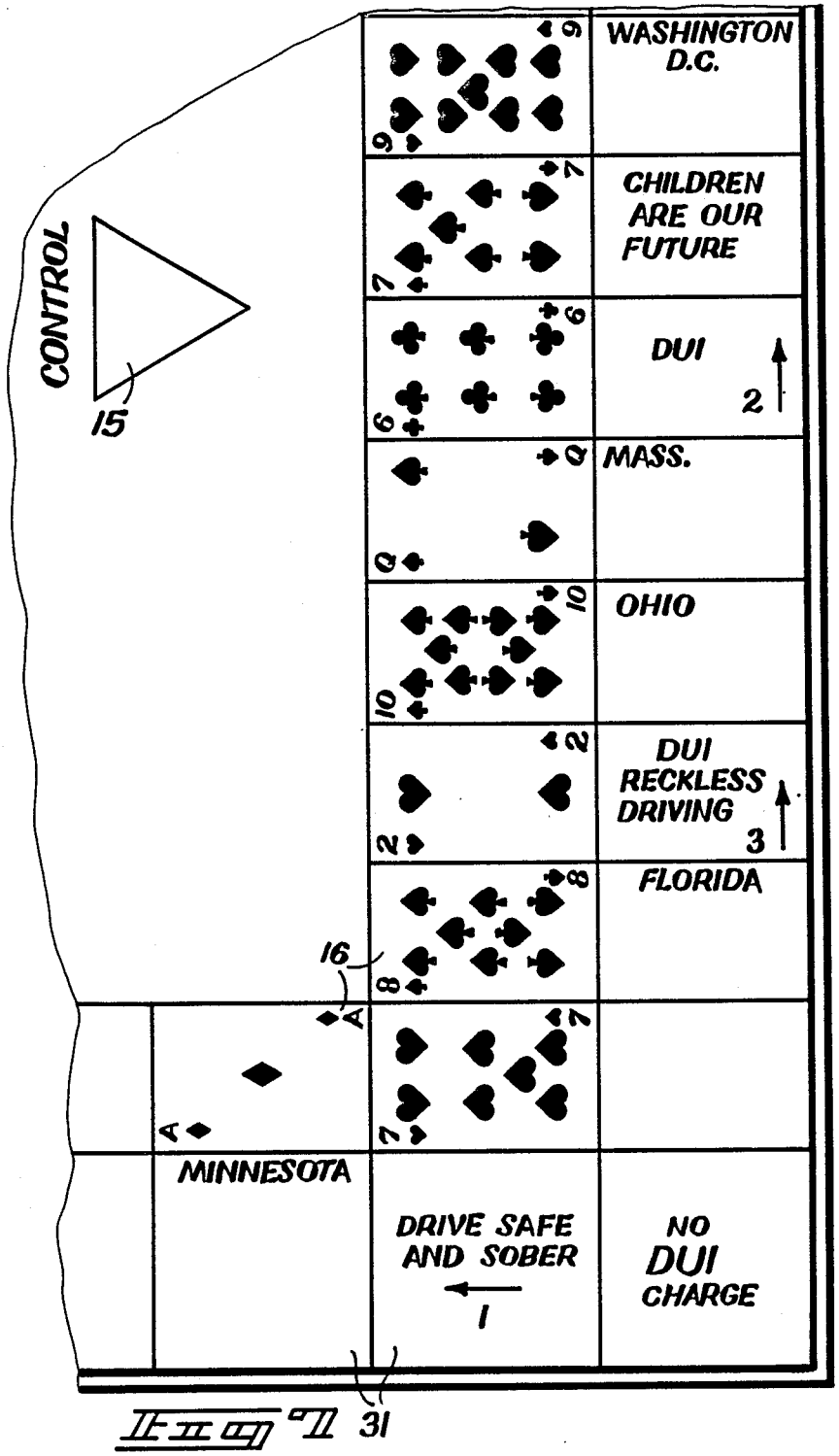
Figure 11:
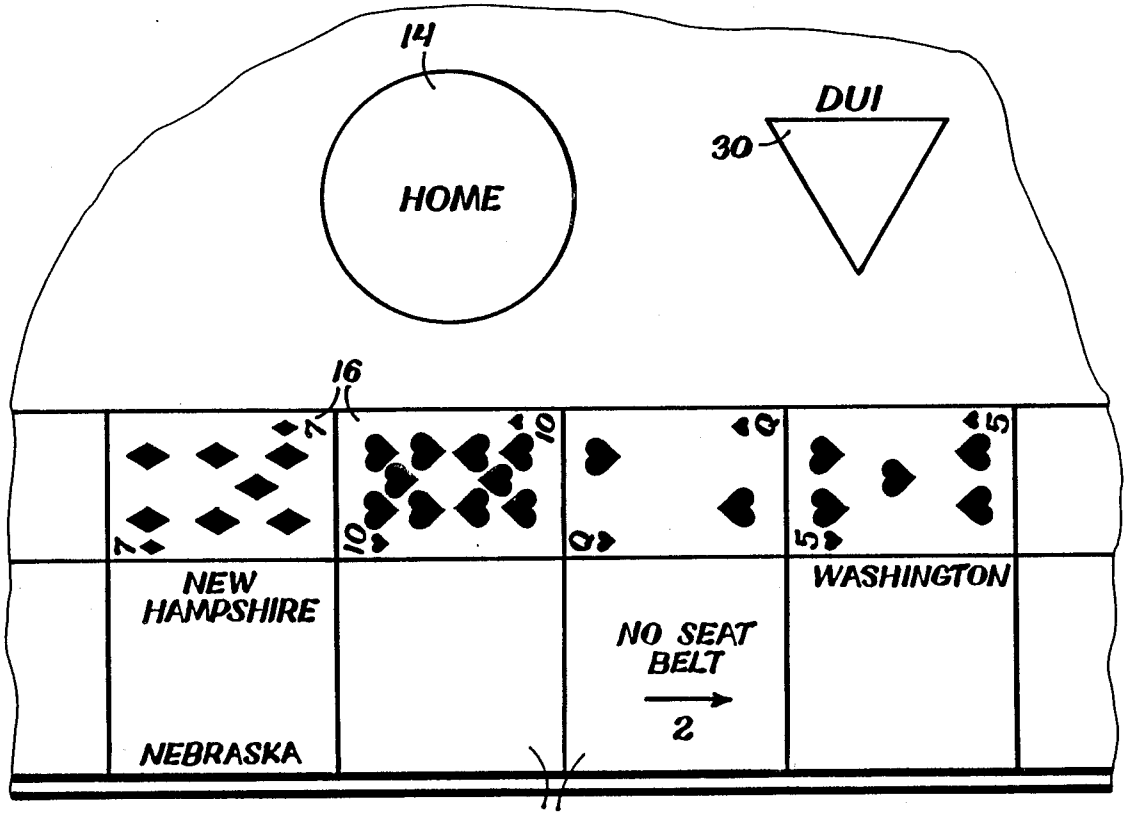
Figure 9:
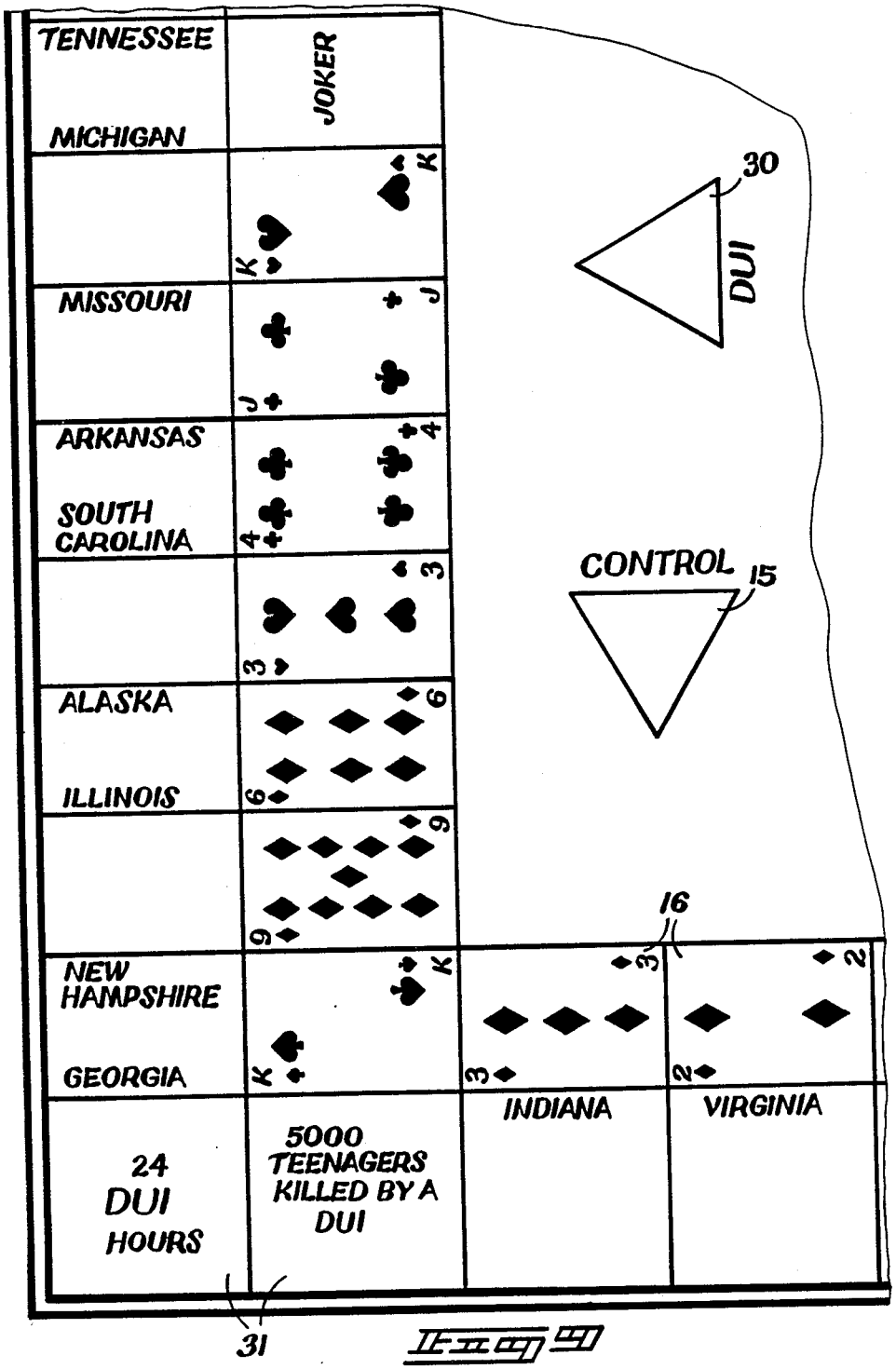
FIG. 9 is a top orthographic view of a fifth portion of the game board.
Figure 11:
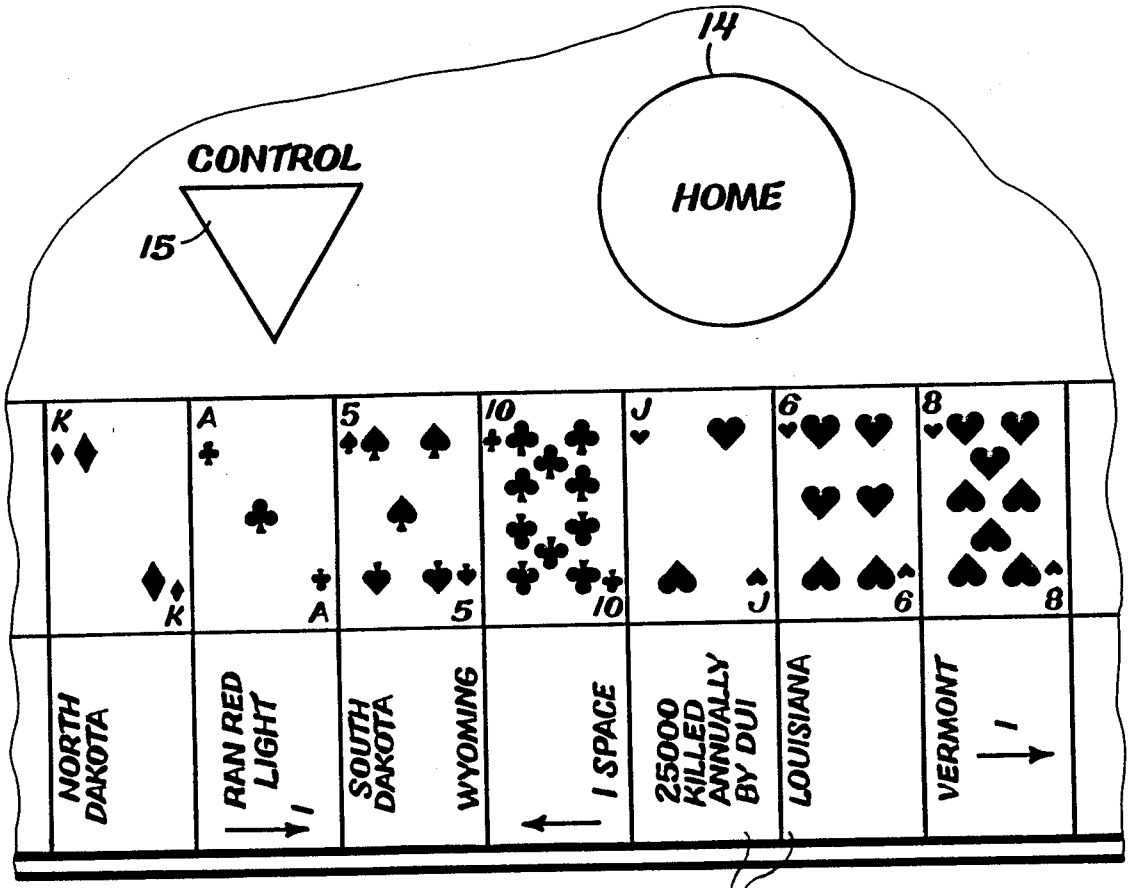
Figure 11:
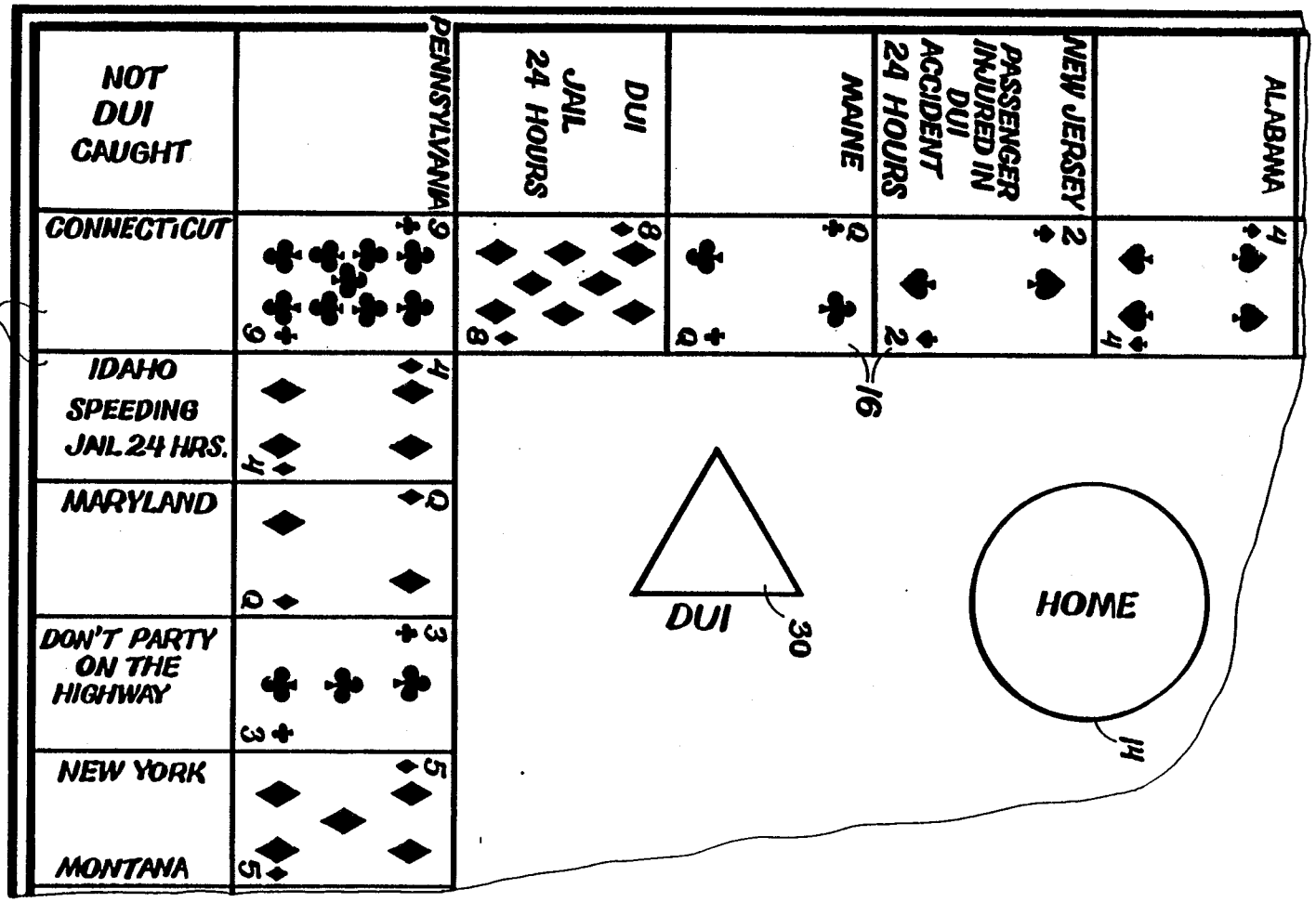

When a player moves into a D.U.I. space, a dice will be rolled to determine the number of spaces to move the corresponding emblem wherein as before, in reference to FIG. 11 as an example, a player will start from the D.U.I. space 30 and should he roll a two, he will move from the Maine space to the next corresponding space setting forth that the has moved into the State of New Jersey, but unfortunately a passenger is injured in an accident. The twenty-four hour description in the space indicates that the player must then be removed from the board and positioned within a jail cage 13 and lose one turn wherein as before, each twenty-four hour penalty is associated with a corresponding loss of one round or turn. Upon a player landing in a space with an arrow pointing in the direction of movement or clockwise, that player may then proceed forward the number of spaced indicated or should an arrow be pointing in a contra direction, that player must move the number of spaces indicated in a contra direction.

Upon overcoming these obstacles, as noted above, the player to completely traverse the route spaces 31 would be declared the winner upon returning to a D.U.I. starting space 30.

It is to be understood that the question and answer cards are to be read by a player immediately to the left of the player drawing the card and that question is accordingly asked of the player drawing the card by the player to his left.

The manner of usage and operation of the present invention should be apparent from the above description and accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing an entertainment and amusement game comprising, providing a game board with a top surface including a plurality of player stations wherein each player station includes a Home space and a first Control pointed space and a second D.U.I. pointed space wherein each of said pointed spaces are on opposite sides of Home space, and A first continuous series of inner spaces on said game board top surface associated with said first pointed space, and a second continuous series of outer spaces contiguous to and adjacent to said first spaces associated with said second pointed space, each respective point of said first and second pointed space is pointing to a respective starting space of said first and second series of spaces, and further providing two decks of conventional playing cards including two Jokers per each deck to provide one hundred and eight playing cards, and providing an arbitrary emblem for each of said players, and providing a predetermined number of reward and penalty cards wherein each of said reward and penalty cards include a statement and a consequence of said statement, and providing a predetermined number of question and answer cards, and wherein said question and answer cards are divided into four series wherein each of said series is associated with each of four suits associated with playing cards, said suits include clubs, diamonds, hearts, and spades providing a game card for each of said players, and providing a predetermined number of tokens for use with each of said playing cards for each player, and providing a dice, and wherein each player initially rolls a dice to proceed from the Home space to the first pointed space upon rolling a predetermined number on said dice, and each player in turn rolls the dice to determine a number of spaces to traverse in a clockwise manner of about said game board on said first series of spaces, and each space of said first series of spaces corresponds to a conventional playing card by suit and designation wherein upon landing on said space, a player guesses that a card chosen from said deck of conventional playing cards will be higher, lower, or the same as the space the player has landed upon, and a upon a correct guess, the player positions one of said tokens on a space of a game card secured by said player, and said game card includes designations corresponding to said conventional playing cards and the player positions a token on the game card only if the game card includes a designation corresponding to the space landed upon by the player, and optionally, if a player incorrectly guesses the chosen playing card the player selects a single of said plurality of question and answer cards and upon a correct answer, the player positions a token on said game card.

2. A method of playing an entertainment and amusement game as set forth in claim 1 wherein moving of said emblems along the outer series of spaces starting from said second pointed space from each player station and traversing said game board in a clockwise manner is determined by the rolling of the dice with consequences and rewards associatred with each of said spaces.

3. A method of playing an entertainment and amusement game as set forth in claim 2 wherein a further step includes providing a cage for each of said players wherein upon obtaining an adverse consequence from said reward and penalty cards, a player's emblem is positioned within said cage and accordingly loses one or ore turns.

4. A method of playing an entertainment and amusement game as set forth in claim 3 wherein a further step includes a player positioning a token on a respective playing card without recourse to penalty and reward cards or questions and answer cards upon drawing a Joker from said decks of playing cards.

5. A method of playing an entertainment and amusement games as set forth in claim 4 wherein each player is provided a plurality of Joker tokens utilized at the discretion of each of said players to fill a space on a respective game card.

* * * * *